US008844773B2

(12) United States Patent
Noordanus

(10) Patent No.: US 8,844,773 B2
(45) Date of Patent: Sep. 30, 2014

(54) WATER RESERVOIR PROVIDED WITH A VOLUTE PUMP CAVITY AND A MOTOR SUPPORT

(75) Inventor: Maximiliaan Noordanus, Noord Scharwoude (NL)

(73) Assignee: Bravilor Holding B.V. (NL)

( * ) Notice: Subject to any disclaimer, the term of this patent is extended or adjusted under 35 U.S.C. 154(b) by 832 days.

(21) Appl. No.: 12/991,410

(22) PCT Filed: May 5, 2009

(86) PCT No.: PCT/NL2009/050243

§ 371 (c)(1), (2), (4) Date: Dec. 10, 2010

(87) PCT Pub. No.: WO2009/136788

PCT Pub. Date: Nov. 12, 2009

(65) Prior Publication Data

US 2011/0083760 A1 Apr. 14, 2011

(30) Foreign Application Priority Data

May 6, 2008 (NL) ..... 2001559

(51) Int. Cl.

| | |
|---|---|
| ***B65D 88/54*** | (2006.01) |
| ***B67D 1/10*** | (2006.01) |
| ***F04D 29/60*** | (2006.01) |
| ***F04D 13/16*** | (2006.01) |

(52) U.S. Cl.

CPC ..... *B67D 1/10* (2013.01); *F04D 29/606* (2013.01); *F04D 13/16* (2013.01)

USPC ... 222/333; 417/424.1; 366/265; 137/565.17; 415/207

(58) Field of Classification Search

USPC ..... 222/145.5–145.6, 146.5, 236–242, 302, 222/333–334, 380, 383.2, 385, 410, 222/464.1–464.7, 251, 255, 258; 417/424.1; 366/262–265, 270; 137/565.17; 415/206–207

See application file for complete search history.

(56) References Cited

U.S. PATENT DOCUMENTS 2,413,546 A * 12/1946 Curtis et al. ..... 222/333
2,740,558 A * 4/1956 Steele ..... 222/242

(Continued)

FOREIGN PATENT DOCUMENTS

| | | |
|---|---|---|
| EP | 0 919 518 A | 6/1999 |
| EP | 1 437 819 A | 7/2004 |
| GB | 2167845 A | 6/1986 |

*Primary Examiner* — Paul R Durand
*Assistant Examiner* — Andrew P Bainbridge
(74) *Attorney, Agent, or Firm* — Meyer IP Law Group

(57) ABSTRACT

A booster pump for a coffee beverage dispenser's water inlet source, in one example, a "city water" inlet. A chamber is formed which has the diluent/water inlet and a bottom surface and a top end covered by a removable lid. The removable lid has a hole large enough for a motor to be partially seated within the chamber and the motor has a shaft with supports that is connected to a cover plate that has through holes, and a rotor below the cover plate with a set of radially oriented vanes. The hole in the lid is bigger than the cross section of the cover plate and so the motor, shaft, supports, rotors and cover plate can be pulled out as desired for easier maintenance. When the motor is seated properly in the hole of the lid, the cover plate seats properly along the edge of a cylindrically shaped pump cavity. The cover plate and the edge form a seal. The inlet for the pump cavity has a smaller cross section than its outlet and the pump cavity can have a deflection body. The outlet for the diluent or water leads to the coffee beverage dispenser device.

15 Claims, 2 Drawing Sheets

(56) References Cited

U.S. PATENT DOCUMENTS

Figure 1:
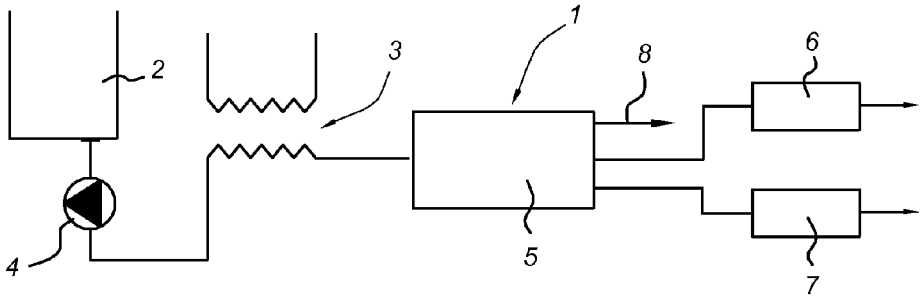

| | | | | | |
|---|---|---|---|---|---|
| 3,055,304 | A * | 9/1962 | Ziegler | 222/54 |
| 3,523,629 | A * | 8/1970 | Chi | 222/241 |
| 3,758,236 | A * | 9/1973 | Zimmerman | 417/360 |
| 3,806,004 | A * | 4/1974 | Kolkovsky | 222/385 |
| 3,934,245 | A * | 1/1976 | Mueller | 345/170 |
| 4,182,596 | A * | 1/1980 | Wellman | 415/207 |
| 4,806,083 | A * | 2/1989 | LaGrange et al. | 417/423.14 |
| 6,273,679 | B1 * | 8/2001 | Na | 415/204 |
| 2007/0065312 | A1 * | 3/2007 | Whitehouse et al. | 417/420 |

* cited by examiner

WATER RESERVOIR PROVIDED WITH A VOLUTE PUMP CAVITY AND A MOTOR SUPPORT

The invention relates to a water reservoir for use in a drink dispenser. The water reservoir is provided with a bottom section and an upper surface disposed at a distance from the bottom section, covered by a lid, wherein a substantially cylindrical pump cavity is formed within the bottom section, with a rotary displacement member arranged about a shaft positioned transversely upon the bottom section. A motor support section extends from a top plate above the displacement member to the lid, upon which a motor is supported, or at least partially supported. The motor is connected to the displacement member via a drive shaft, wherein the motor is disposed or at least partially disposed within the reservoir via a hole in the lid.

In such a device, for example, water is conveyed from the water reservoir via the pump to a heating device from which warm water is conveyed to a distributor. The warm water is delivered to a user and/or to one or more drink processing devices via the distributor. This is described, for example, in NL6000164 and NL6000166.

EP 1245013 and P 0811345 describe systems which operate on the basis of gravitational force and which deliver a fixed quantity of fluid. Such a system is not suitable for the delivery of variable quantities of fluid, such as water. Furthermore, only a limited volume of fluid can be delivered per unit of time, using the known systems.

Another drawback of the known systems is that the various parts always need to be in a more or less fixed position in relation to one another. This means that a fixed space must be reserved in an apparatus with a limited freedom of space in order for the system to be used, thus restricting options in the design of the apparatus. Particularly in devices for which one of the requirements is that they must be capable of delivering both a relatively small quantity of drink or water (0.1 to 0.2 liter), as well as being able to rapidly deliver 1.8 liters for a jug, these drawbacks are a handicap. In addition, the requirements generally also dictate that the device must be as compact (small) as possible and that such dispensing devices are expected to be capable of making a multiple of drinks from various different ingredients. The combination of requirements, delivery of approximately 0.15 liter to approximately 1.8 or more liters in a relatively short period of 10 to 90 seconds, several drinks from water and various ingredients and a very compact design, means that the reservoir and the dimensions of the system must be sufficiently large, yet be constructed very compactly, so that optimal use is made of any space in the device.

However, most known systems have a number of drawbacks.

The pump, for example, requires a fairly large space for it to be installed in, especially if it is required to pump larger volumes rapidly, at least in the case of an automatic drink dispenser. This is often caused partly by the fact that the pump needs to be suitable for conveying a fluid, for consumption, which is probably also hot (>82° C.).

The distribution device which is applied in conjunction with the pump and which must be adapted thereto is also often relatively large. In addition, these distribution devices usually have problems with air bubbles which may impede the through-flow if they are used for larger quantities, say 1.5 liters per minute. To this end, in the past a de-aeration system was conceived according to patent EP1462040.

It is therefore an object of the invention to provide a water reservoir from which water with a relatively high flow rate can be delivered to various drink dispensing devices and/or users. It is a further object of the invention to provide a water reservoir of relatively small dimensions. It is also an object of the invention to provide a water reservoir from which the pump and displacement member can easily be detached for the purpose of maintenance, inspection and/or replacement.

To this end, a water reservoir according to the invention is characterized in that the pump cavity on the upper surface is closed off with a circular top plate supported by a support member in close proximity to an upper edge of the pump cavity, wherein the hole in the lid has a diameter larger than the circular top plate.

By closing the pump cavity on the upper surface with the circular plate, a simple support of the motor on the bottom of the reservoir can be achieved, wherein the walls of the pump cavity are formed by the bottom of the reservoir. The circular plate can be fitted through the hole in the lid, so that the lid does not need to be detached from the reservoir for the purpose of inspection, maintenance or replacement during the installation of the motor and removal thereof. Preferably, the motor is mounted close to the hole and detachable from the lid, for example by means of a screw thread or a bayonet-type connection.

In one embodiment, the drive means comprises a support plate connected to the drive shaft and, on the side facing the motor, a deflecting vane is attached to the support plate. By mounting the vanes to the support plate, water extracted from the reservoir and pumped into the pump cavity is deflected in a radial direction to an outlet at the bottom of the pump cavity, the outlet being disposed at a radial distance from the support plate.

Preferably, a flow channel is formed in the bottom section around the central section, which is circumscribed by the sidewalls; with an inflow point and an outflow point which connect to a discharge positioned transversely upon the bottom section, wherein the cross-sectional surface of the flow channel increases from the inflow point towards the outflow point. In this manner a volute is formed from the tangential pump so that a relatively high throughput is achieved with the use of a small volume pump.

To direct the flow of water close to the outflow point to a vertically downward discharge, a deflection body can be positioned in the flow channel laterally in relation to the circumferential direction of the flow channel.

Figure 2:
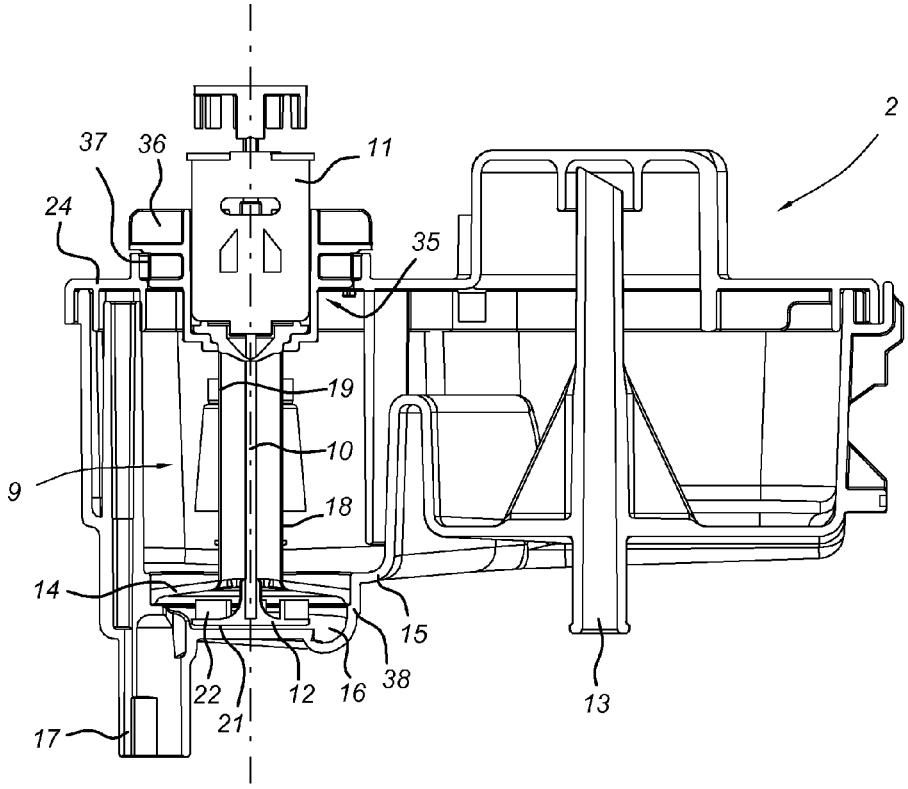
Figure 3:
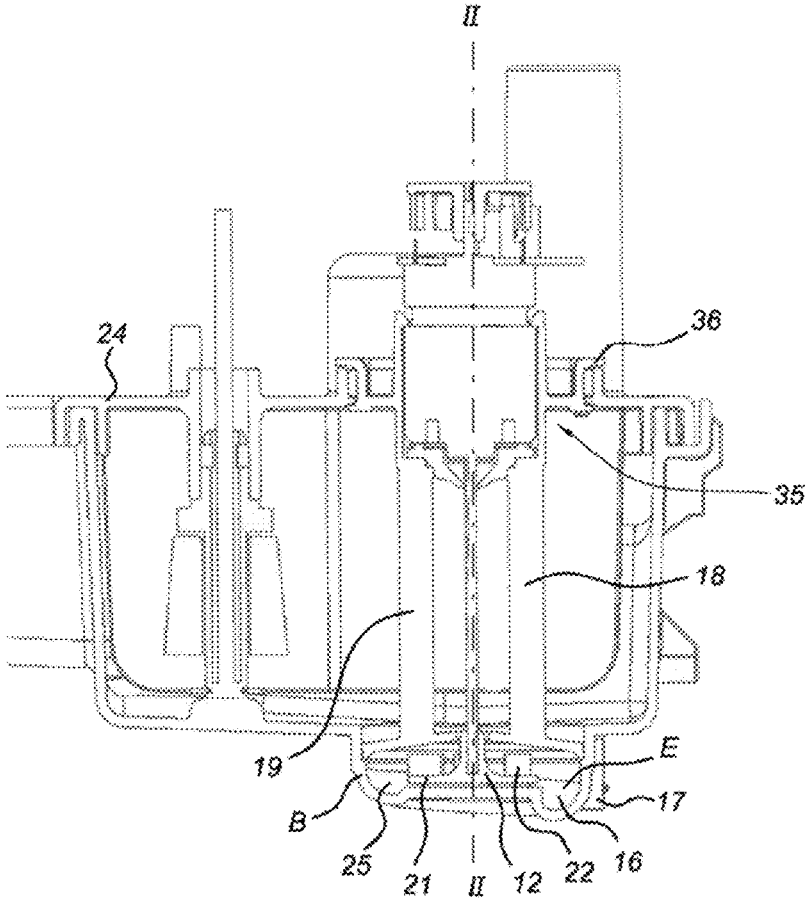
Figure 4:
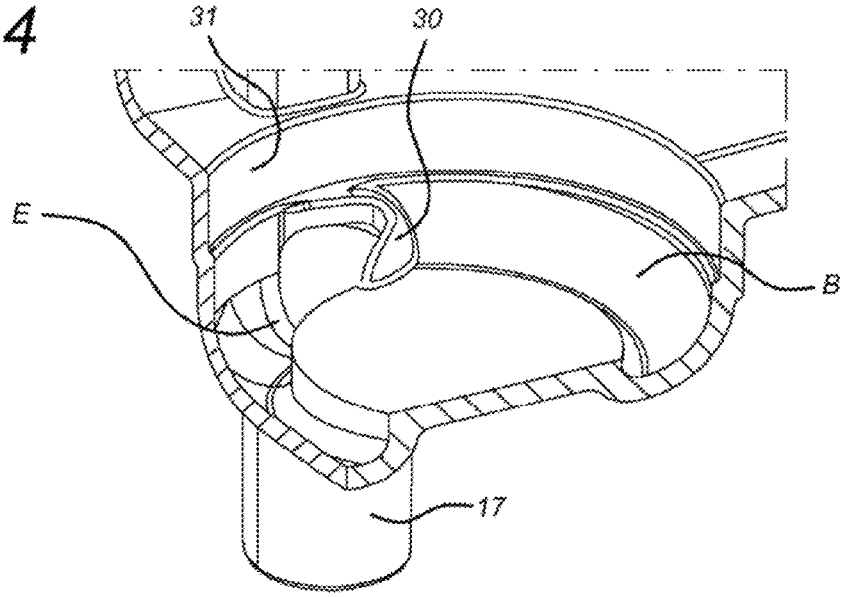

Now, turning to the figures, an embodiment of a pump according to the invention will be described in further detail by way of example, with reference to the appended drawings, in which:

FIG. 1. shows a schematic view of a drink dispensing device, wherein the distributor according to the invention can be applied, FIG. 2 shows a cross-section of a water reservoir according to FIG. 1, along the line II-HH in FIG. 3, FIG. 3 shows a cross-section of the water reservoir according to FIG. 1, along the line III-III in FIG. 2, and FIG. 4 shows a view in perspective of a deflection body positioned close to the outflow opening of the pump housing.

FIG. 1. shows a drink dispensing system 1, for example a coffee machine, with a water reservoir 2 and a pump integrated in the bottom of this reservoir, a heat exchanger 3, a distributor 5 and drink processing means 6 and 7. Upon heating to a temperature of approximately 80° C. in the heat exchanger 3, the water in the water reservoir (2) is delivered by the pump 4 to an inlet of the distributor 5. Here, the flow rate may amount to between 0.1 and 0.2 liters per minute and is delivered directly to a user via an outlet 8, or, for example, to one of the drinks processing devices 6, 7 for making coffee, or other warm drink like soup. Higher flow rates can be delivered directly via an outlet 8, for example to a jug (such as 1.51 p/m), or to the drinks processing devices 6, 7.

FIG. 2 shows the water reservoir 2 with a supply means 13. The reservoir is covered on an upper surface by a lid 24. At the bottom 15 of the reservoir 2, a pump cavity 16 is formed with a discharge 17. A displacement member 12 is disposed within the pump cavity in the form of a rotor, of a pump 9, which is made to rotate via a shaft 10 by an electromotor 11.

The pump 9 is of the centrifugal pump type and is fitted close to or even at the base 15 of the reservoir. The rotor 12 of the pump and the pump itself, of course, is mounted in a horizontal plane.

A cover plate 14 is fitted above the rotor 12, with supports 18, 19, which support the shaft 10 and for a part the motor, which is disposed at some distance (outside of the reservoir) there above.

In the bottom 15 of the reservoir, cavities are formed corresponding to the shape of the pump cavity required for the pump.

The cover plate 14 above the rotor 12 seals off the cavities on the upper surface. In order to supply the fluid, the water, to the rotor 12, the cover plate 14 is provided with openings around the shaft feed-through. The level of the fluid in the reservoir is maintained at a reasonable height above the inlet openings using means generally known in the prior art, so that this remains constantly below the fluid/water level and ensures an adequate (required) supply of fluid.

The rotor 12 itself comprises a plate 21, to which an upwardly facing shaft fixture is attached, with a number of vanes 22 arranged in an annular configuration around the shaft and facing upwards. Because the plate 21 is positioned beneath the rotor, this immediately provides an adequate sealing with the bottom section of the reservoir disposed underneath.

The cavity in the bottom is provided with a flow channel 25, which has a slightly larger diameter than the rotor, and is disposed around the inner surface thereof with a downwardly facing diameter. The channel or flow channel runs from a given starting point B (see FIG. 3), where the diameter is relatively small, in a circular manner to an end point E, close to the starting point, wherein the diameter becomes increasingly larger, thus forming a volute.

At the end point E of the flow channel, a raised edge 30 (see FIG. 4) is disposed at right angles to the diameter, which is designed in such a manner that, as a result, the flow of water is deflected downwards towards the outlet 17. This outlet is further provided with a de-aeration means as described in patent EP1462040. Due to the downwardly directed outlet 17, it is possible to manufacture the reservoir from plastic, particularly the bottom section with the pump housing disposed therein, with relatively simple dies/moulds and very few additional operations using widely available production techniques. This contributes to an effective and economically beneficial production of the system.

In view of the production and, later, for the provision of maintenance with regard to the entire reservoir, including the pump, the preferred embodiment can therefore remain relatively simple.

In a complete reservoir i.e. with the lower and upper sides mounted upon one another, the entire pomp 9, including the top plate 14, the rotor 12 and the supports 18, 19 is mounted via an opening 35 in the lid 24 of the reservoir. The motor is attached to a specially formed flange 36, which is also provided on its outer edge with a bayonet-type connection or screw thread 37, with which this can be fastened in the opening of the lid, which is provided for that purpose with the counterpart of the bayonet-type connection or screw thread.

The flange 36 is connected via the supports 18, 19 to the cover plate 14 above the rotor 12. Once mounted, the entire arrangement is partially supported by the cover plate 14 which, in turn, rests on an edge 38 running along the interior of the pump cavity 16 at the bottom 15, while it is further firmly held in place by the flange 36 in the hole 35 of the lid 25 of the reservoir 2.

The outlet 17 of the pump 19 is connected directly or indirectly, either to an outlet from the device or to the previously mentioned distributor with the central outlet. This may be any one of the configurations indicated in the patent P1462040 and the equivalents thereof.

The invention claimed is:

1. A reservoir (2) adapted to provide a fluid, comprising:

a bottom section (15) and an upper surface disposed at a distance from the bottom section covered by a lid (24), wherein a substantially cylindrical pump cavity (16) is formed within the bottom section, with a rotary displacement member (12) arranged about a drive shaft (10) disposed transversely upon the bottom section, wherein the pump cavity (16) is closed off on an upper side by a circular top plate (14) which is supported by a support member (38) close to an upper side of the pump cavity, wherein fluid is introducible into the pump cavity (16) through openings in the circular top plate (14) at a feed-through for the drive shaft (10) in the circular top plate (14), wherein a motor support section (18, 19) extends from the circular top plate (14) to the lid (24) on which a motor (11) is supported or at least partially supported, said motor (11) being connected to said displacement member (12) by the drive shaft (10), wherein the motor (11) is positioned or at least partially positioned within the reservoir via a hole (35) in the lid (24), and wherein said hole (35) in the lid (24) has a diameter larger than the circular top plate (14); and wherein the circular top plate (14) and said displacement member (12) are insertable into the reservoir (2) via said hole (35) in the lid (24) and the circular plate (14) is thereafter positionable on the support member (38).

2. The reservoir (2) according to claim 1, wherein the motor (11) is detachably connected therewith via fastening means (36, 37) close to the hole (35) in the lid (24).

3. The reservoir (2) according to claim 1, wherein the drive means (12) comprises a support plate (21) connected to the drive shaft (10) and, on the side facing the motor (11), deflecting vanes (22) attached to said support plate.

4. The reservoir (2) according to claim 1, wherein a flow channel is formed in the bottom section (5) around the central section of the pump cavity (16), circumscribed by the side wall (31), with an inflow point (B) and an outflow point (E) which connect to a discharge (17) positioned transversely upon the bottom section, wherein the cross-sectional surface of the flow channel increases from the inflow point (B) towards the outflow point (E).

5. A reservoir (2) adapted to provide a fluid, comprising:

a bottom section (15) with a substantially cylindrical pump cavity (6) disposed therein, with a cylindrical side wall (31) and a central section (21) onto which a displacement body is rotatably arranged around a shaft (10) disposed transversely upon the bottom section, wherein the shaft is connectable with a motor mountable to the reservoir for rotating the shaft, a circular top plate (14) supportable by an edge (38) formed in the cylindrical sidewall (31) to at least partially enclose the pump cavity (6) from above, one or more supports (18, 19) extending from the circular top plate (14) away from edge (38) formed in the cylindrical sidewalls, wherein when the motor is mounted to the reservoir, the circular top plate (14) is fixed in position against the edge (38) by the one or more supports (18, 19), wherein a flow channel (25) is formed in the bottom section around the central section which is circumscribed by the side wall (31), with an inflow point (B) and an outflow point (E) which connects to a discharge (17) positioned transversely upon the bottom section, wherein the cross-sectional surface of the flow channel increases from the inflow point (B) towards the outflow point (E).

6. The reservoir (2) according to claim 5, wherein a deflection body (30) is arranged in the flow channel (25) transversely in relation to the circumferential direction of the flow channel, in close proximity to the outflow point (E).

7. The reservoir (2) according to claim 4, wherein a deflection body (30) is arranged in the flow channel (25) transversely in relation to the circumferential direction of the flow channel, in close proximity to the outflow point (E).

8. A reservoir adapted for holding a fluid to be dispensed via an outlet, comprising:

a bottom;

an upper surface arranged above the bottom;

a lid connectable to the upper surface;

a pump cavity within the bottom having a side wall shaped to define a volute extending to the outlet;

a cover plate supportable by an edge formed in the sidewall of the pump cavity, the cover plate configured to at least partially enclose the pump cavity from above; and one or more supports extending from the cover plate toward the lid when the lid is connected to the upper surface;

wherein the cover plate includes a feed-through for receiving a shaft, and one or more openings for introducing the fluid to the pump cavity; and wherein the reservoir is adapted to receive a motor assembly comprising a motor, a shaft rotatably connected with the motor, and a rotor connected with the shaft;

wherein the motor assembly is mountable to the reservoir so that the rotor is positioned within the pump cavity to urge fluid through the pump cavity to the outlet; and wherein when the motor assembly is mounted to the reservoir, the cover plate is substantially fixable in position against the edge of the side wall of the pump cavity by the one or more supports.

9. The reservoir of claim 8, wherein the lid includes a hole for receiving the motor assembly; and wherein the motor assembly is mountable to the reservoir by detachably connecting the motor assembly to the lid when the motor assembly is received in the hole and the lid is connected with the upper surface.

10. The reservoir of claim 9, wherein the hole in the lid is larger than the cover plate such that the cover plate is insertable through the hole; and wherein the rotor, the shaft, and the cover plate are insertable into the reservoir via the hole in the lid and the cover plate is thereafter positionable on the edge formed in the sidewall of the pump cavity.

11. The reservoir of claim 8, wherein the rotor includes a plate connectable with the shaft and a plurality of deflecting vanes extending from the plate for urging the fluid through the pumping cavity.

12. The reservoir of claim 8, wherein the pump cavity includes a raised edge arranged transversely in relation to a rotational plane of the rotor when the motor assembly is mounted to the reservoir, wherein the raised edge is configured to deflect fluid toward the outlet.

13. The reservoir according to claim 1, wherein motor support section (18, 19) includes a flange (36) attachable to the lid (24).

14. The reservoir according to claim 5, wherein the one or more supports (18, 19) include a flange (36) attachable to the lid (24) and wherein the motor is mountable to the reservoir via the one or more supports (18, 19).

15. The reservoir of claim 8, wherein the one or more supports include a flange attachable to the lid; and wherein the motor is mountable to the reservoir via the one or more supports.

* * * * *